United States Patent [19]

Mitchell

[11] 4,378,387

[45] Mar. 29, 1983

[54] METHOD OF DECORATING MATERIAL

[76] Inventor: Michael G. Mitchell, Duchy Manor Mill, Hazzards Hill, Mere, Nr. Warminster, Wiltshire, England

[21] Appl. No.: 65,644

[22] Filed: Aug. 10, 1979

[51] Int. Cl.[3] ..... B05D 5/06

[52] U.S. Cl. ..... 427/263; 8/486; 427/265

[58] Field of Search ..... 8/7, 16, 486; 427/263, 427/268, 430 R, 439, 434 A, 262, 267, 280, 281, 434.2, 434.3, 265; 118/402

[56] References Cited

U.S. PATENT DOCUMENTS

| | | | |
|---|---|---|---|
| 855,474 | 6/1907 | Newbery | 118/402 |
| 1,923,909 | 8/1933 | Brown | 118/402 |
| 1,931,667 | 10/1933 | Loetscher | 118/402 X |
| 2,140,498 | 12/1938 | Dreyer | 118/402 |
| 2,981,632 | 4/1961 | Bennett | 118/402 X |

*Primary Examiner*—Evan K. Lawrence

[57] ABSTRACT

A method of decorating material for example paper consists of superimposing one marbled pattern on top of another marbled pattern. The marbled patterns are produced by floating and combining marbling ink on the surface of a bath of size solution. The upper marbled pattern consists of linear regions of ink formed by interspersing ink with transparent expanding agent on the surface of the size bath so that the ink is confined by the compressive effect of the expanding agent, thus the pattern is in outline only. The ink and expanding agent are applied to the surface of the size bath using a specially constructed frame comb.

7 Claims, 3 Drawing Figures

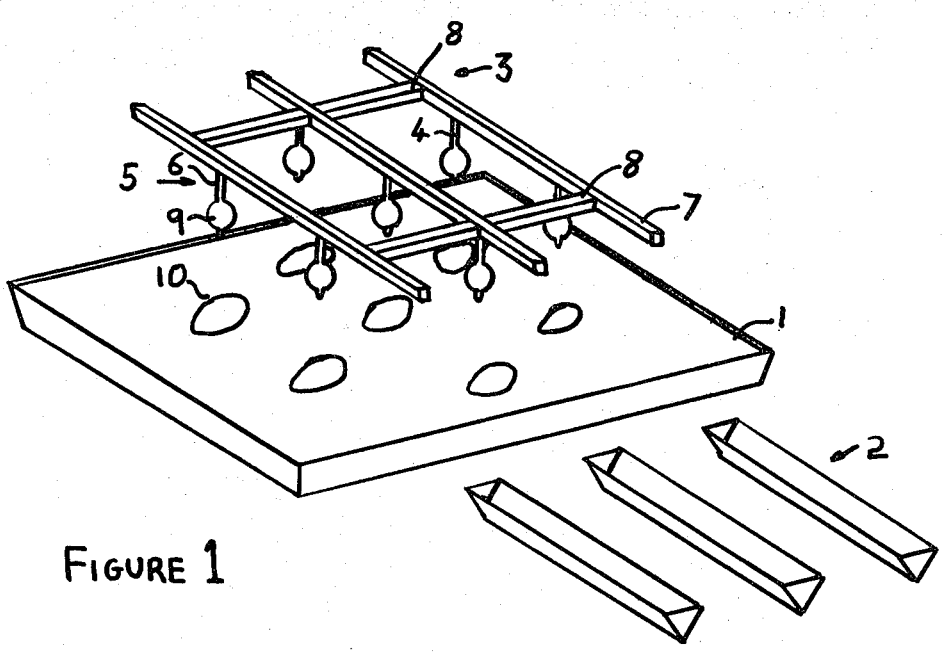
FIGURE 1
FIGURE 2A
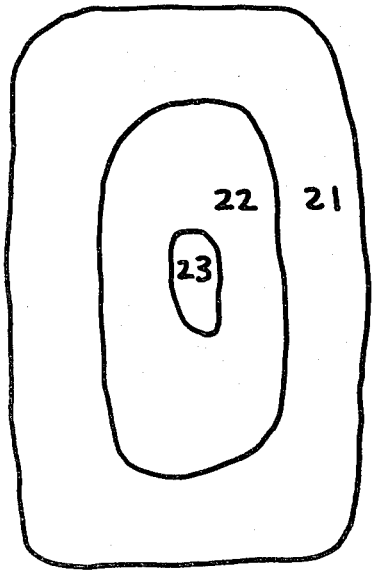
FIGURE 2B
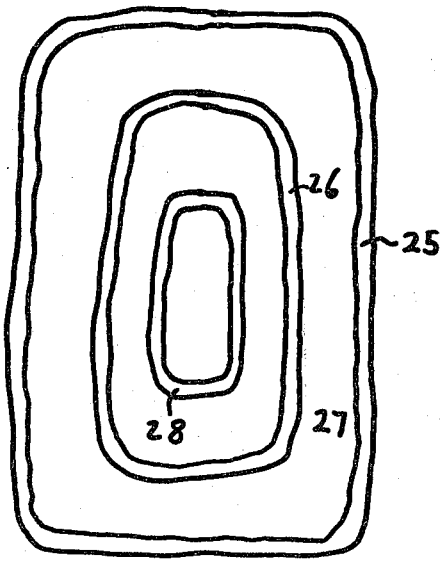

METHOD OF DECORATING MATERIAL

INTRODUCTION

This invention relates to a method of decorating material and more particularly but not exclusively to decorating paper by marbling.

The craft of decorating paper by the technique generally known as marbling has been known for centuries. It was at one time commonly used on the covers, edges and end papers of account books and ledgers.

Recently, however, the marblers' attention has focussed more on his product as an art form. Each sheet, is separately decorated and thus has subtle differences from other sheets even though it may be produced using the same method and ingredients as other sheets.

The basic process of marbling is described in a leaflet published by Dryad Ltd of the Dryad Press, Leicester, England and also of Wood-ridge, New Jersey, USA. The leaflet is No 74 in a series of leaflets published by Dryad Ltd and is entitled 'Three Methods of Marbling'. The reader will find that Method No 1 described therein is most useful. From the leaflet it can be seen that marbling is a printing method wherein inks are formed into the desired pattern on a bath of liquid and then transferred to paper.

A number of variations on the basic marbling process are possible. One is to apply the ink to the bath in a regular pattern, and comb the entire bath with a regular sequence of strokes. This gives a particularly pleasing regular pattern.

It has been observed in general that interesting effects can be produced by superimposing two or more spatially regular visual stimuli. Attempts to do this with marbling have in the past been unsuccessful. This failure has been due to the difficulty of keeping each marbled pattern sufficiently distinct in itself to give rise to the desired visual effect.

SUMMARY OF THE INVENTION

An object of this invention is to provide a method whereby marbled patterns may be superimposed while allowing each pattern to remain visually distinct. According to the invention there is provided a method of decorating material including the steps of applying to several points simultaneously of the surface of a volume of liquid medium colored marbling ink to form a first pattern of ink on the surface of the volume of liquid medium, bringing material into contact with said surface to transfer the ink of the first pattern to the material, applying to several points simultaneously on the surface of a clean volume of liquid medium in turn marbling ink and a transparent expanding agent so that the expanding agent displaces at least some of the ink on the volume of liquid medium and forms a second pattern on the surface on the liquid medium in which the ink is confined by the expanding agent to substantially linear regions and bringing the material into contact with the surface of the liquid medium to transfer the ink of the second pattern to the material, whereby the first and second patterns are superimposed and the first pattern consists of continous bands of color and the second of separated thin linear bands.

DESCRIPTION OF THE DRAWINGS

A method of marbling paper which embodies the invention will now be described by way of example only, making reference to the accompanying drawings in which FIG. 1 shows a simplified perspective view of a bath of viscous size solution, a frame comb and ink troughs.

FIGS. 2A and 2B each show a part of a pattern formed on the surface of the size solution.

DETAILED DESCRIPTION

Referring to FIG. 1 a bath of a viscous solution of size for example that which can be derived from Caragheen Moss has placed along side it V shaped ink troughs 2. Shown above the bath in FIG. 1 is a frame comb 3 consisting of several wooden cross members, one of which is designated by the reference numeral 7 in FIG. 1. The cross members are separated by rungs 8. For convenience only three cross members are shown, but in paractise as many as are required to produce the desired marbling pattern are used. Suspended from the underside of each cross member are several teeth, however the number can vary. The teeth of the frame comb 3 are arranged in a staggered manner as this reduces the gap between adjacent teeth. Each tooth for example tooth 5 consists of a shaft 6 constructed of a conventional darning needle and has a swollen portion formed by mounting a bead on the darning needle. The shaft 6 extends below the lower end of the swollen portion 9 by about a quarter of an inch. The point of the darning needle is embedded in the cross member and the eye forms the part of the shaft which extends below the bottom of the swollen portion 9. Before the apparatus of FIG. 1 is used a sheet of paper is mordanted by applying to it a dilute solution of alum and allowing it to dry. Then a marbling ink of suitable composition is prepared and poured into the V shaped troughs 2. Preparation of marbling ink is described in the Dryad leaflet referred to above. It consists essentially of mixing an expanding agent, for example ox-gall to a colored ink normally six drops of ox-gall to two thirds of an ounce of ink. Ox-gall and ink suitable for marbling are available from Artists' Suppliers. U.S. Pat. No. 2,118,781 gives details of how to make up marbling inks to give various rates of dispersion. That disclosure is incorporated herein by reference. The frame comb 3 is then placed above the troughs 2 so that its teeth dip into the ink. It is then agitated until each of the swollen portions of the teeth is covered with ink. The comb is then transferred to the position shown in FIG. 1 and lowered gently onto the surface of the size solution contained in the bath 1 until the tip of each tooth of the comb just touches the surface of the solution in the bath. As soon as the tip of each tooth touches the surface of the size solution, the ink which is adhering to the surface of the tooth runs down the shaft onto the size solution. Once on the surface of the size it spreads to form a pool of ink such as that designated 10 in FIG. 1. The presence of the swollen portion on the tooth increases the surface area of the tooth and thus allows it to retain more ink and forms a greater pool than it would otherwise. The shaft 6 extends below the swollen portion so that for each tooth the ink is guided down into a small area of the surface of the size bath. The ink troughs 2 and the frame comb 3 are now replaced by similar ink troughs containing a different colored marbling ink and a second frame comb of the same construction as the frame comb 3. This ink is prepared so that when it is applied to the size bath it is capable of spreading despite the presence of the pools of the first ink. The technique for the preparation of marbling inks is well known. Using the second frame comb the second ink is transferred to the surface of the size solution where it desplaces outwards the first ink. The ink troughs are then replaced with troughs containing a third colored ink which is transferred to the size solution in the same way as the previous two colored inks using a third frame comb. FIG. 2A shows one of the pools of ink formed by the sequential transfer of three colored inks to the surface of the size bath. The first ink forms an outer ring 21, the second a middle ring 22 and the third the central disc 23. The pools such as that illustrated in FIG. 2A lie in staggered rows corresponding to the arrangement of teeth on the frame comb 3. Before the ink is transferred to paper it is pulled into a pattern using a pulling through comb or a needle, as with conventional marbling. The mordanted paper is then laid on the surface of the size bath, whereupon it absorbs the pattern of the ink. The paper is then removed from the bath and allowed to dry. On removal from the bath the paper carries with it a thin layer of size which helps seal the colored inks on the paper. When the ink of the first pattern is dry the paper is again mordanted. Then using a clean bath of size solution a first colored ink is placed on the surface of the size solution but using an ordinary frame comb i.e one without swollen portions in a similar manner as previously described. After the first ink has spread to the desired extent the frame comb is removed and the ink troughs are replaced by troughs containing transparent expanding agent such as ox-gall. This is then transferred to the surface of the size solution using a second ordinary frame comb in the same way as was the first ink. As the tip of each tooth of the frame comb touches the surface of the liquid in the bath the expanding agent runs down the particular tooth into the center of the pool of the first ink displacing it with great readiness. The troughs are then replaced with troughs containing a second marbling ink which is then applied to the surface of the size solution using a third ordinary frame comb. Expanding agent is then applied for a second time, a third ink is then applied and is followed by a third application of expanding agent. The alternate application of ink and expanding agent causes a formation of ink and agent on the surface of the size bath which consists of pools, each one resembling that illustrated in FIG. 2B. In FIG. 2B the first marbling ink has been forced outwards by the first application of expanding agent. The second ink has been compressed to form a thin ring 26 by the expanding agent of the first application 27 and the second application of expanding agent. Similarly the third ink has also been uniformly compressed to form a thin ring 28. The first ink is compressed between the first application of expanding agent from the one tooth and the application from other adjacent teeth of the frame comb to form a ring 25. Thus the alternate application of ink and expanding agent causes a pattern of compressed ink to be formed. For the best compression effect the inks used for the second pattern should be prepared with progressively more expanding agent. Suitably the last ink has three times the normal amount, the second ink has twice the normal amount and the first ink has the normal amount.

When the pattern of compressed ink is formed it is pulled into and desired shape using the pulling through comb or needle. The ink is then transferred to the paper by laying the paper on the surface of the size solution. The paper is removed and hung up to dry. The paper now carries two marbled patterns, one printed on top of the other. The first pattern consists of continuous areas of color. The second pattern consists of thin linear bands of color separated by gaps produced by the expanding agent. Any swirls and shapes produced in the second printing are defined only in outline by the thin linear bands of color. When, however, a sheet of such marbled paped is viewed from a distance the second pattern appears as prominent as the first pattern. The two marbled patterns appear superimposed without any loss of distinctiveness. A particularly good result can be obtained by selecting the tints of the colored ink in the first pattern to contrast with those of the inks of the second pattern. More or less applications of colored inks than three can be used for either or both patterns, but there is practical difficulty of floating more than about five colors simultaneously on size. An added advantage obtained by superimposed marbling is that as the paper has been marbled twice a double layer of size exists on its surface. This seals the inks on the paper better than would a single layer.

Using the method of the invention it is also possible to superimpose more than two marbled patterns and superimpose two or more outline marbled patterns. In the first case at least the second and subsequent patterns must be in outline.

A possible alternative to the frame comb of needle at FIG. 1 is a frame of droppers. Each dropper is mounted in a position corresponding to the position of a needle in FIG. 1. A board is provided over the top of the frame so that pressure on the board compresses the rubber teats of all the droppers simultaneously. Alternatively a separate board maybe provided for each row so that the rows of droppers can be used independantly. The board or boards may be hinged on the frame and may be spring loaded.

While the invention has been illustrated above in relation to paper it is also applicable to other materials including non-lamina articles. Many variations are possible within the scope of the invention even the adaptation of the process for continuous printing, perhaps by using a jelly coating on a drum as the liquid medium.

What I claim is:

1. A method of decorating material including the steps of applying at least once to several points simultaneously of the surface of a volume of liquid medium colored marbling ink to form a first pattern of ink on the surface of the volume of liquid medium consisting of continuous areas of color, bringing material into contact with said surface to transfer the ink of the first pattern to the material, allowing the first pattern to dry, applying at least once to several points simultaneously on the surface of a clean volume of liquid medium in turn marbling ink and a transparent expanding agent so that the expanding agent displaces at least some of the ink on the clean volume of liquid medium and forms a second pattern on the surface of the liquid medium in which the ink is confined by the expanding agent to substantially linear regions, and bringing the material having the first pattern thereon into contact with the surface of the liquid medium to transfer the ink of the second pattern to the material whereby the first and second patterns are superimposed and the first pattern consists of continuous areas of color and the second of separated thin linear bands.

2. A method according to claim 1 wherein the step of applying the marbling ink in the formation of the first pattern includes the successive steps of applying ink of each color of more than one color of ink, and the step of applying in turn marbling ink and transparent expanding agent includes the successive steps of applying the transparent expanding agent immediately after applying ink of each one color of more than one color of ink.

3. A method according to claim 2 wherein in the formation of each pattern the ink of applications after the first application is applied to the volume of liquid medium in the same place as the ink of the previous application.

4. A method according to claim 1 wherein the expanding agent is ox-gall and the liquid medium is a viscous solution of size.

5. A method according to claim 1 wherein both the ink and the expanding agent are applied using a frame comb.

6. A method according to claim 1 wherein the material is paper and includes the further steps of mordanting the paper immediately prior to transferring to it the inks of the first pattern and mordanting the paper immediately prior to transferring to it the inks of the second pattern.

7. A method according to claim 1 or 2, wherein the first and second patterns are both modified by being disturbed prior to their respective transfers to the material.

* * * * *